US010681945B2

(12) United States Patent
Nijmeh

(10) Patent No.: US 10,681,945 B2
(45) Date of Patent: Jun. 16, 2020

(54) CONVERTIBLE INSULATED SMART GLOVE

(71) Applicant: George Constandi Nijmeh, Walnut Creek, CA (US)

(72) Inventor: George Constandi Nijmeh, Walnut Creek, CA (US)

(73) Assignee: DESIGNS 4U, Inc., Walnut Creek, CA (US)

( * ) Notice: Subject to any disclaimer, the term of this patent is extended or adjusted under 35 U.S.C. 154(b) by 316 days.

(21) Appl. No.: 15/817,618

(22) Filed: Nov. 20, 2017

(65) Prior Publication Data

US 2018/0140026 A1 May 24, 2018

Related U.S. Application Data

(60) Provisional application No. 62/424,767, filed on Nov. 21, 2016.

(51) Int. Cl.

| | |
|---|---|
| ***A41D 19/015*** | (2006.01) |
| ***A41D 15/00*** | (2006.01) |
| ***A41D 15/04*** | (2006.01) |
| ***A44B 1/00*** | (2006.01) |
| ***A41D 19/04*** | (2006.01) |
| ***A41D 19/01*** | (2006.01) |
| *A41D 31/30* | (2019.01) |

(52) U.S. Cl.

CPC ..... *A41D 19/01594* (2013.01); *A41D 15/005* (2013.01); *A41D 15/04* (2013.01); *A41D 19/01* (2013.01); *A41D 19/01529* (2013.01); *A41D 19/04* (2013.01); *A44B 1/00* (2013.01); *A41D 31/30* (2019.02); *A41D 2300/32* (2013.01); *A41D 2300/322* (2013.01); *A41D 2300/324* (2013.01); *A41D 2300/52* (2013.01); *A41D 2400/36* (2013.01); *A41D 2400/80* (2013.01); *A44D 2203/00* (2013.01)

(58) Field of Classification Search

CPC ..... A41D 19/01594; A41D 19/005; A41D 19/04; A41D 19/01; A41D 19/01529

See application file for complete search history.

(56) References Cited

U.S. PATENT DOCUMENTS 944,949 A * 12/1909 Cormey ..... A41D 19/01 2/158

2,299,118 A 10/1942 Wheeler (Continued)

*Primary Examiner* — Richale L Quinn

(74) *Attorney, Agent, or Firm* — Michael Petrin; Antero, Tormey & Petrin

(57) ABSTRACT

A convertible insulated glove capable of being reconfigured into the form of two separately detachable half sections for the handling and placement of hot or cold objects intended to be worn on a person's hand when joined together, or alternatively used with one or both hands as pot holders when separated to protect the hands from exposure to temperature extremes. Alternatively, an insulated glove that can be partially opened or fully separated to form one or more trivets to protect a surface from a hot or cold object placed therebetween. Further, a convertible insulated glove having additional features rendering it easier to clean and resist the growth of microorganism for improved sanitation and safety with the handling of foods, as well as preventing stains and malodors from developing during use.

15 Claims, 6 Drawing Sheets

(56) References Cited

U.S. PATENT DOCUMENTS 4,027,339 A 6/1977 Brucker
5,329,639 A * 7/1994 Aoki ..... A63B 71/143 2/16
5,432,991 A * 7/1995 Godleski ..... A63H 3/14 116/306
5,956,770 A * 9/1999 Dennis ..... A47L 13/18 15/227
6,338,163 B1 * 1/2002 Markson ..... A41D 19/0017 2/161.6
6,612,056 B1 9/2003 Thomas, II
6,957,448 B2 * 10/2005 Grilliot ..... A41D 19/01529 2/161.6
7,530,876 B1 5/2009 Wimberly
9,914,042 B2 * 3/2018 Chorne ..... A41D 13/084
2006/0080757 A1 * 4/2006 Beyda ..... A41D 19/01529 2/164
2007/0204382 A1 * 9/2007 Williams ..... A41D 19/01547 2/159
2008/0313785 A1 12/2008 Rudd et al.
2009/0222973 A1 9/2009 Merkle
2010/0235962 A1 * 9/2010 Grilliot ..... A41D 19/015 2/161.6
2014/0026290 A1 * 1/2014 Howland ..... A41D 19/015 2/161.6
2014/0143925 A1 * 5/2014 Chorne ..... A63B 71/143 2/20
2014/0215683 A1 * 8/2014 Ford-Roberts ..... A41D 13/081 2/158
2014/0245517 A1 * 9/2014 Henry ..... A41D 19/01 2/16
2015/0052656 A1 * 2/2015 Poznick ..... A41D 19/0024 2/16
2015/0196829 A1 7/2015 Lefens
2015/0265478 A1 * 9/2015 Seelinger ..... A61F 13/104 602/1
2015/0305416 A1 * 10/2015 Chorne ..... A63B 71/143 2/16

* cited by examiner

CONVERTIBLE INSULATED SMART GLOVE

PRIORITY

This present application claims the benefit of the earlier filed provisional U.S. patent application Ser. No. 62/424,767, filed on Nov. 21, 2016, which is hereby incorporated by reference herein in its entirety.

BACKGROUND

Cooking and preparing baked and barbecued goods in the home, kitchen and campground generally involve the handling of hot objects such as cookware, pans, pots, plates and other cooking accessories and tools that cannot be safely or comfortably held by hand without some form of protection. However, kitchens are becoming increasingly filled with accessories and tools, having limited storage spaces so that a device or tool that can serve multiple purposes is welcome, saving space as well as providing multiple functions and uses. While kitchen gloves are common and handy accessories, they generally function only as gloves to protect one's hands from hot objects and are not suited for use for other purposes, such as for example, for use as a trivet to protect a susceptible surface, such as a countertop or table, from the same hot object. In addition, after typical and normal use, kitchen gloves can become soiled by liquids, food, food residues, spills and perspiration released by a user's hand, leaving the gloves somewhat unpalatable for the continued use and handling of foods and their containers.

Accordingly, it would be desirable to have a kitchen or barbecue glove that has the capability of providing multiple functions, such as for example, functioning as a glove and as one or more trivets to protect either a user or a surface from contact with a hot or cold object. In addition, it would be desirable to have a kitchen or barbecue glove that has the capability of providing several simultaneous functions, such as for example, functioning as a glove but providing additional properties such as easier cleaning, stain and soil resistance, water and oil resistance and/or repellency, antimicrobial or odor control efficacy, faster drying, and combinations thereof, serving to provide a glove with a cleaner and more sanitary contact surface for the handling of foods and containers, and around food contact surfaces.

More specifically, it would also be desirable to have a kitchen or barbecue glove whose surfaces have the property, either inherently or by means of some suitable treatment applied thereon, to resist or prevent contaminants or stains from adhering thereon, or resist or prevent the attachment, growth and spread of microbial organisms, or alternatively, to ease the removal of such contaminants, stains or microbial organisms from said surface during a cleaning or rinsing procedure applied to restore those surfaces to a clean or pristine condition following use.

Accordingly, one object of the present invention is a convertible insulated glove in the form of two separately attached half sections for the handling of hot or cold objects, one embodiment of the inventive glove fitting either the left or right hand of the user, or the use of two such gloves worn on both hands.

Another object of the present invention is a convertible insulated glove in the form of two separately attached half sections that can be divided into at least two objects that can serve as trivets for the purpose of insulating a susceptible surface, such as a countertop, table or tray, from a hot or cold object.

Another object of the present invention is a convertible insulated glove in the form of two separately attached half sections that can be divided into at least two objects that can serve as mitts each having means for engaging at least one finger of at least one user's hand to enable control and positioning of said mitt for the purpose of insulating a user's fingers or hands from a hot or cold object.

A further object of the present invention is a convertible insulated glove in the form of two separately attached half sections that are constructed of, or whose surfaces thereof have been treated with, a material that serves to resist or prevent contaminants or stains from adhering thereon.

Yet another object of the present invention is a convertible insulated glove in the form of two separately attached half sections that are constructed of, or whose surfaces thereof have been treated with, a material that serves to ease the removal of contaminants or stains from said surfaces during a cleaning or rinsing procedure applied to restore that surface to a clean or pristine condition following use.

Another object of the present invention is a convertible insulated glove in the form of two separately attached half sections that are constructed of, or whose surfaces thereof have been treated with, a material that serves to resist or prevent the attachment, growth and spread of microbial organisms, or alternatively, to ease the removal of microbial organisms and their byproducts, such as stains and odors, from said surface during a cleaning or rinsing procedure applied to restore that surface to a clean or pristine condition following use.

SUMMARY

Disclosed herein are various aspects of the present invention relating to an multipurpose insulative glove that can be used as an integrated unit, or reversibly separated into one or more sections in the form of mittens or trivets that can be used independently of one another, the sections made of an insulative material that protects a user's hand or appendage from hot or cold objects when gripping said objects, or protects a surface from said objects when used as a trivet therebetween.

One aspect of the present invention is an insulative glove comprising a front section including a body portion, a thumb portion and one or a plurality of finger portions; a rear section including a body portion, a thumb portion and one or a plurality of finger portions; wherein said front and rear sections each include a reversible joinder means capable of removably attaching and securing said front and rear sections together; wherein said joinder means is positioned on a bias portion located adjacent to the periphery of said front and rear sections; wherein said joinder means is configured to enable said front and rear sections to be reversibly attached to one another along said bias portion to form an integrated unit; wherein said front and rear sections are joined to form an integrated unit including at least one hand receiving region and a thumb region, and optionally one or more of a plurality of finger regions, a palm region and a wrist region; and an open region for insertion of a user's hand or appendage thereof into said hand receiving region; wherein said front and rear sections are constructed of at least one layer of a thermal insulative material; and wherein said front and rear sections may be separated and detached from one another to form a plurality of either a mitt or a trivet when said sections are not joined together as an integrated unit.

Another aspect of the present invention includes use of a joinder means comprising a zipper, wherein the zipper is located on a bias portion at a location having a displacement from said periphery of said front and rear sections equal to at least a distance selected from (a) the height of said zipper; (b) the height of the slider mechanism of said zipper; or (c) the height of said zipper combined with the height of said slider mechanism of the zipper.

Yet another aspect of the present invention includes use of a joinder means selected from a hook and loop closure, slider closure, mechanical snap, button, magnetic closure, magnetic snap, and combinations thereof.

A further aspect of the present invention includes an integrated glove wherein at least one of said front or rear sections further includes one or a plurality of a pocket selected from a thumb pocket, finger pocket, palm pocket, hand pocket, and combinations thereof; wherein said pocket is a partially closed region with at least one opening for insertion of said appendage including a thumb, finger, palm, and hand; and wherein said pocket is attached to the inside or interior region of said front or rear section.

A related aspect of the present invention includes an integrated glove wherein at least one of said front or rear sections further includes one or a plurality of a sleeve selected from a thumb sleeve, finger sleeve, palm sleeve, hand sleeve, wrist sleeve and combinations thereof; wherein said sleeve is a partially closed region in the form of a loop secured at both ends thereof with at least two openings for insertion of said appendage including a thumb, finger, palm, hand and wrist; and wherein said sleeve is attached to the inside or interior region of said front or rear section.

Yet another aspect of the present invention includes an integrated glove wherein said front and rear sections comprise thermal panels of an insulative material; wherein said thermal panels are selected from a single layer, double layer or triple layer of said insulative material; and wherein said layer of insulative material has an R value of between 1.0 to 20 when combined into three or more layers; or alternatively between 1.0 to 10 when combined into two or more layers; or alternatively between 1.0 to 5 when using a single layer thereof; and optionally, wherein said thermal panels of insulative material are quilted across their cross-sections to form a quilted surface pattern on at least one exterior side of at least one of said front or rear sections; and wherein said quilted surface pattern provides at least one of either an improved gripping ability and increased insulative value of the exterior side of said thermal panels.

In one aspect of the present invention said thermal panels of said front or rear sections of one or more layers of said insulative material are joined along their perimeters to form a bias portion that is located immediately adjacent to the outer periphery of said sections and inside the outer perimeter of said seconds; and wherein said bias portion may be in the form of a seam, hem, double hem, triple hem, bonded region, compressed region or combination thereof.

In another aspect of the present invention at least one exterior side of at least one thermal panel has been modified to exhibit an additional beneficially property; wherein said modification is performed on at least one layer of said panel by a treatment mean applied either to said panel or to at least one surface of said panel; wherein said treatment means provides at least one beneficial property selected from anti-static, easier-cleaning, grip or friction enhancement, flame resistant, water-repellency, oil-repellency, soil resistance, stain resistance, antimicrobial resistance, germicidal activity, odor control, antistatic properties, and combinations thereof.

In a related aspect of the present invention the treatment means comprises use of a treatment agent applied to at least one layer of at least one said panel by means of dipping, soaking, spraying, rolling, pressing or bonding, or a combination thereof; and wherein said treatment agent is selected from a bonded abrasive, friction coating, polymer, copolymer, silicone resin, fluoropolymer, perfluorinated copolymer, mineral, polysiloxane, quaternary biocide, silver biocide, silver nanoparticles, resin, wax, and combinations thereof; and wherein said treatment means is applied to at least one exterior surface of at least one said thermal panel; and optionally, wherein said treatment means is applied either (a) in a non-continuous manner in the form of a pattern of dots, lines, squares, squiggles, and other similar geometric patterns; or (b) as a discreet coating disposed on the surface of said thermal panel; and wherein said treatment means provides improved grip and friction enhancement to said surface of said panel compared to an untreated surface.

A further aspect of the present invention includes a hanging means attached to at least one position along said bias portion of either one of said first and second panels; wherein said position disposes said hanging means to the exterior of said integrated unit when said front and rear sections are joined together; and wherein said hanging means is selected from a loop, hook, magnetic loop, magnet and combinations thereof, in order to provide a convenient way to hang or store the invention.

Another aspect of the present invention is to provide an integrated tool system in the form of a convertible insulated glove having a first section and a second section; wherein said first and second section share a complimentary joinder means located along a bias portion of each of said sections enabling said two sections to be combined into an integrated unit joined along the bias portion located within the periphery of said integrated unit with at least one portion defining an opening capable of receiving a user's hand or appendage; wherein at least one of said first or second section further comprises either one of (a) at least one or a plurality of a pocket selected from a thumb pocket, finger pocket, palm pocket, hand pocket, and combinations thereof; wherein said pocket is a partially closed region with at least one opening for insertion of said appendage including a thumb, finger, palm, and hand; and wherein said pocket is attached to the inside or interior region of said front or rear section; or (b) at least one or a plurality of a sleeve selected from a thumb sleeve, finger sleeve, palm sleeve, hand sleeve, wrist sleeve and combinations thereof; wherein said sleeve is a partially closed region in the form of a loop secured at both ends thereof with at least two openings for insertion of said appendage including a thumb, finger, palm, hand and wrist; and wherein said sleeve is attached to the inside or interior region of said front or rear section; wherein said first or second section having at least one of said pockets or said sleeves may be used separately as a mitten by means of a user's hand or an appendage thereof being inserted into at least one of said pockets or sleeves; wherein said joinder means is selected from a hook and loop closure, slider closure, mechanical snap, button, magnetic closure, magnetic snap, zipper, and combinations thereof; wherein said first and second section may either be joined to form an integrated unit in the form of glove; or may be separated to use as one or two individual mittens or trivets; and wherein said first and second section are constructed of a thermal panel of an insulative material.

A further aspect of the present invention includes an integrated tool system having a zipper as joinder means; wherein said zipper is located on said bias portion at a location having a displacement from said periphery of said front and rear sections equal to at least a distance selected from (a) the height of said zipper; (b) the height of the slider mechanism of said zipper; or (c) the height of said zipper combined with the height of said slider mechanism of the zipper.

Yet another aspect of the present invention includes an integrated glove wherein the front and rear sections comprise thermal panels of an insulative material; wherein said thermal panels are selected from a single layer, double layer or triple layer of said insulative material; and wherein said layer of insulative material has an R value of between 1.0 to 20 when combined into three or more layers; or alternatively between 1.0 to 10 when combined into two or more layers; or alternatively between 1.0 to 5 when using a single layer thereof; and optionally, wherein said thermal panels of insulative material are quilted across their cross-sections to form a quilted surface pattern on at least one exterior side of at least one of said front or rear sections; and wherein said quilted surface pattern provides at least one of either an improved gripping ability and increased insulative value of the exterior side of said thermal panels.

One aspect of the present invention further includes an integrated glove wherein at least one exterior side of at least one thermal panel has been modified to exhibit an additional beneficially property; wherein said modification is performed on at least one layer of said panel by a treatment mean applied either to said panel or to at least one surface of said panel; wherein said treatment means provides at least one beneficial property selected from anti-static, easier-cleaning, grip or friction enhancement, flame resistant, water-repellency, oil-repellency, soil resistance, stain resistance, antimicrobial resistance, germicidal activity, odor control, antistatic properties, and combinations thereof; wherein said treatment means comprises use of a treatment agent applied to at least one layer of at least one said panel by means of dipping, soaking, spraying, rolling, pressing or bonding, or a combination thereof; and wherein said treatment agent is selected from a bonded abrasive, friction coating, polymer, copolymer, silicone resin, fluoropolymer, perfluorinated copolymer, mineral, polysiloxane, quaternary biocide, silver biocide, silver nanoparticles, resin, wax, and combinations thereof; wherein said treatment means is applied to at least one exterior surface of at least one said thermal panel; wherein said treatment means is applied optionally in (a) a continuous manner; or (b) in a non-continuous manner in the form of a pattern of dots, lines, squares, squiggles, and other similar geometric patterns; or (c) wherein said treatment means is present as a discreet coating disposed on the surface of said thermal panel.

Figure 1:
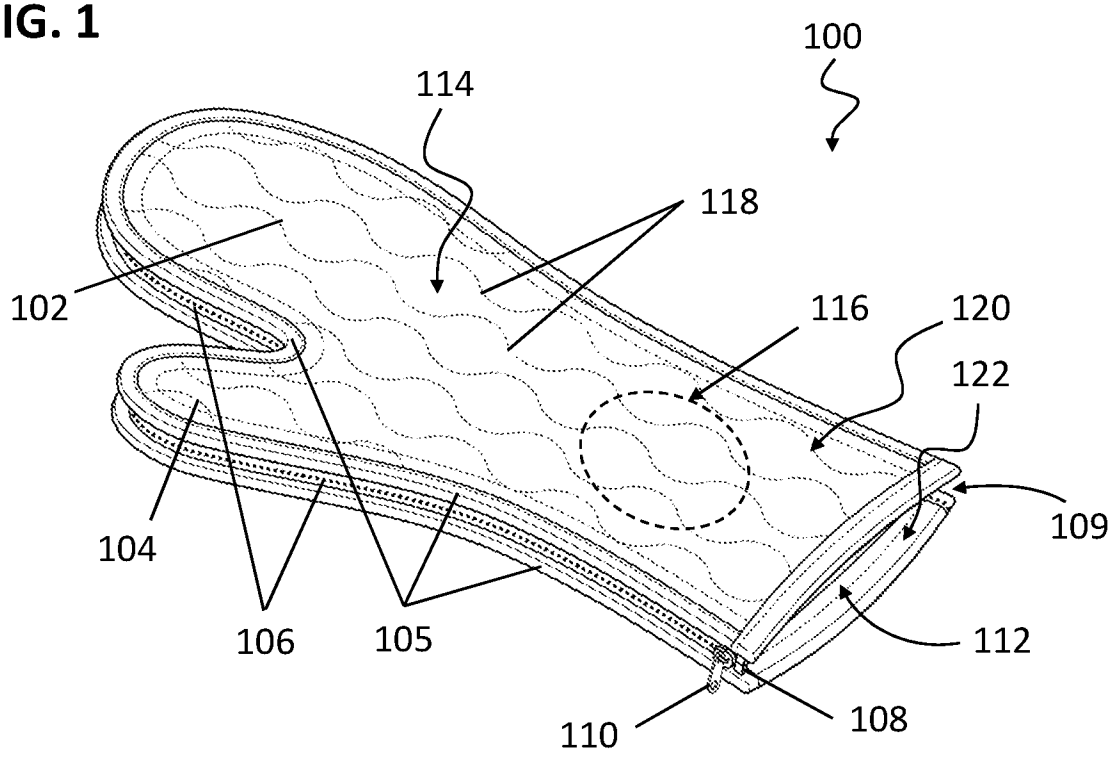
FIG. 1 shows a top perspective view of one embodiment of a glove or mitten constructed as two mirror image half sections connected together with a zipper means.

A corresponding set of figure keys listing the specific component parts, regions and means of embodiments of the present invention are included for convenience in reviewing each of the drawings presented herein and are found in the Appendix accompanying this specification for patent.

DESCRIPTION

Generality of Invention

This application should be read in the most general possible form. This includes, without limitation, the following:

References to specific techniques include alternative and more general techniques, especially when discussing aspects of the invention, or how the invention might be made or used.

References to "preferred" techniques generally mean that the inventor contemplates using those techniques, and thinks they are best for the intended application. This does not exclude other techniques for the invention, and does not mean that those techniques are necessarily essential or would be preferred in all circumstances.

References to contemplated causes and effects for some implementations do not preclude other causes or effects that might occur in other implementations.

References to reasons for using particular techniques do not preclude other reasons or techniques, even if completely contrary, where circumstances would indicate that the stated reasons or techniques are not as applicable.

Furthermore, the invention is in no way limited to the specifics of any particular embodiments and examples disclosed herein. Many other variations are possible which remain within the content, scope and spirit of the invention, and these variations would become clear to those skilled in the art after perusal of this application.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Read this application with the following terms and phrases in their most general form. The general meaning of each of these terms or phrases is illustrative, not in any way limiting.

Detailed Description

The following embodiments presented in the included figures describe various configurations and options featured by the instant invention relating to an insulated mitt that can be used in the kitchen to handle hot and cold items, for barbecuing to hold hot items and accessories, and also used as a trivet or set of trivets to protect surfaces from hot objects placed upon them.

One embodiment of the present invention is shown in FIG. 1, relating to an insulated glove 100 that is constructed of two half sections, a top halve 120 and bottom halve 122 that are partially connected together along their outer peripheries by means of a zipper 106, which connects the outer boundary of the two half sections leaving a glove opening 112 that can accommodate the insertion of a user's hand. The insulated glove 100 has an exterior surface 114 made of a quilted insulative material, sewn with an exterior bias portion or edging 105 that accommodates the zipper 106, which consists of two half sections (not shown), one half section 106A that is connected or sewn to the top halve 120 and the second, complementary half section 106B that is connected or sewn to the bottom halve 122, and which are reversible interconnected by means of a zipper pull tab 110 and corresponding zipper mechanism (details not shown) that starts at a zipper start position 109 and ends a zipper terminus position 108. The exterior surface 114 and interior surface 115 (not shown) are constructed in a quilted pattern 116 covering the extent of the top halve 120 and bottom halve 122 surfaces of the insulated glove 100, defined by a plurality of thread traces 118, which act together to form a quilted region featuring a plurality of raised portions and depressed portions, the former being between the treaded traces 118 and the latter being where the threaded traces 118 are present. This quilted pattern is optional, but is a preferred embodiment for insulated gloves according to the present invention intended for the handling of extremely hot and cold objects, as the quilted pattern results in the formation of air channels in the vicinity of the depressed portions thereof, which trap air and effectively increase the insulative value (R) of the glove's surfaces. In the inventive embodiment shown in FIG. 1, when the two half sections of the glove (120 and 122) are connected, they form a glove with a glove opening 112 that can accommodate a user's hand, providing a finger section 102 and a thumb section 104 that engages the user's hand to securely hold the glove in position thereon.

Figure 2:
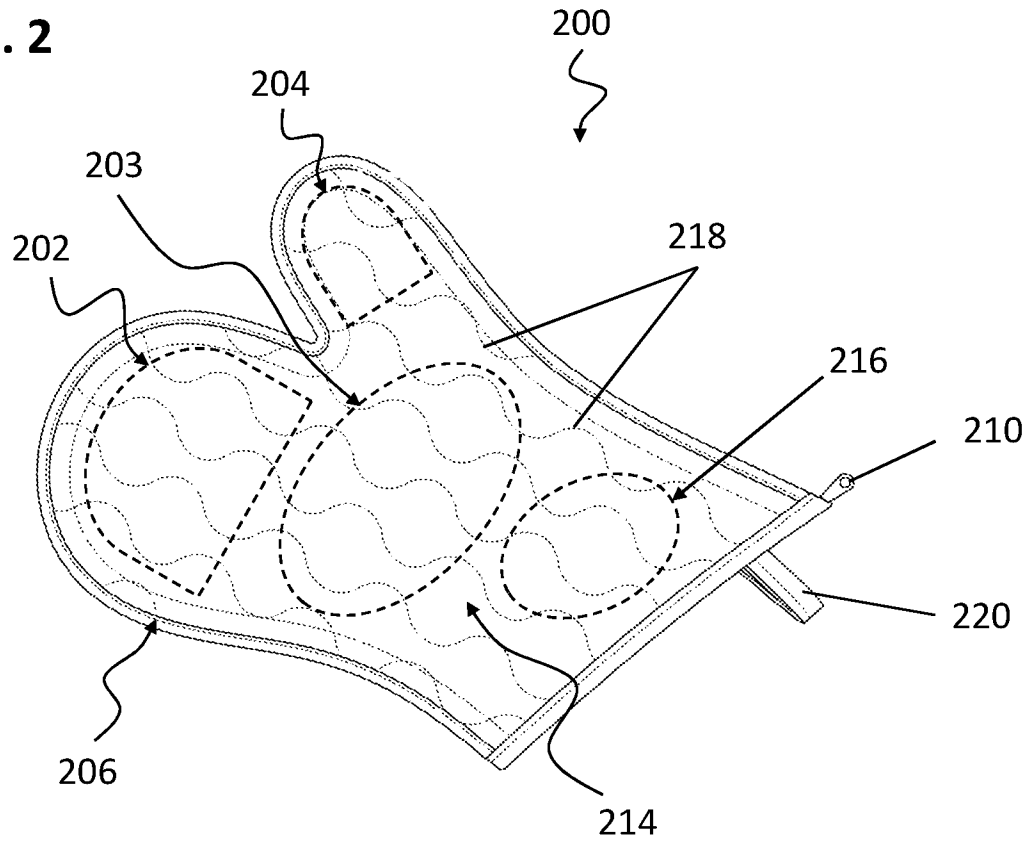
FIG. 2 shows a top view of one embodiment of a kitchen mitt illustrating the quilted construction and a convenient hanger tab.

FIG. 2 describes another embodiment of the instant invention, showing a top view of the exterior surface 214 of one half section of an insulated glove having a finger region 202, a palm region 203 and a thumb region 204. In related embodiments, one or more of these regions (202, 203 and 204) may be constructed of a thicker material or have additional padding or insulation present in order to offer a greater insulative value (R) in those regions to better protect a user's hand from hot and cold objects that are brought into intimate contact with the glove, and particularly in those regions due to the gripping force applied by the user's hands through the glove to bear onto the object being held or manipulated therewith. In other embodiments, these regions (202, 203 and 204) are made of a single quilted panel 216 of material without any additional material present, being one or a plurality of layers of an insulative material that is quilted by means of a plurality of thread traces 218 which produce the quilted panel 216. The quilted panel 216 can be constructed from a single layer of insulated material, or in other embodiments of the present invention, be constructed of two or more layers of a protective exterior layer, slip-free friction layer, water proof layer, or the like, or combinations thereof, in combination with at least one layer of an insulating material. In other embodiments of the present invention, the quilted panel 216 may be constructed of a single layer of insulative material whose surfaces, or at least one surface thereof, preferentially the exterior surface, bears a functional coating or applied treatment that can provide an additional benefit selected from, but not limited to, stain proofing, water, stain and soil resistance and/or repellency, antimicrobial or biostatic activity, odor control, gripping improvement, and combinations thereof. In the inventive embodiment shown in FIG. 2, the insulated glove also features an optional hang tab loop 220 that enables the user to hang the glove from a hook or other support, for convenience in storage and access when needed.

In the embodiments disclosed above, the single or plurality of material layers used to construct the quilted panel 216 are generally hemmed by means of a bias portion or edging, the former being a fold of the material back onto itself that is sewn to prevent a raw edge of the panel material from being exposed, the latter being an additional piece of material sewn to surround the raw edge of the panel, respectively. In other embodiments, the edge of the panel material can be biased by other means, including thermal bonding, adhesive bounding, compressive bonding, or other such means capable of sealing and finishing the raw edge of the panel material so as to prevent the insulative core or material from becoming frayed, delaminated or damaged during use.

Figure 3:
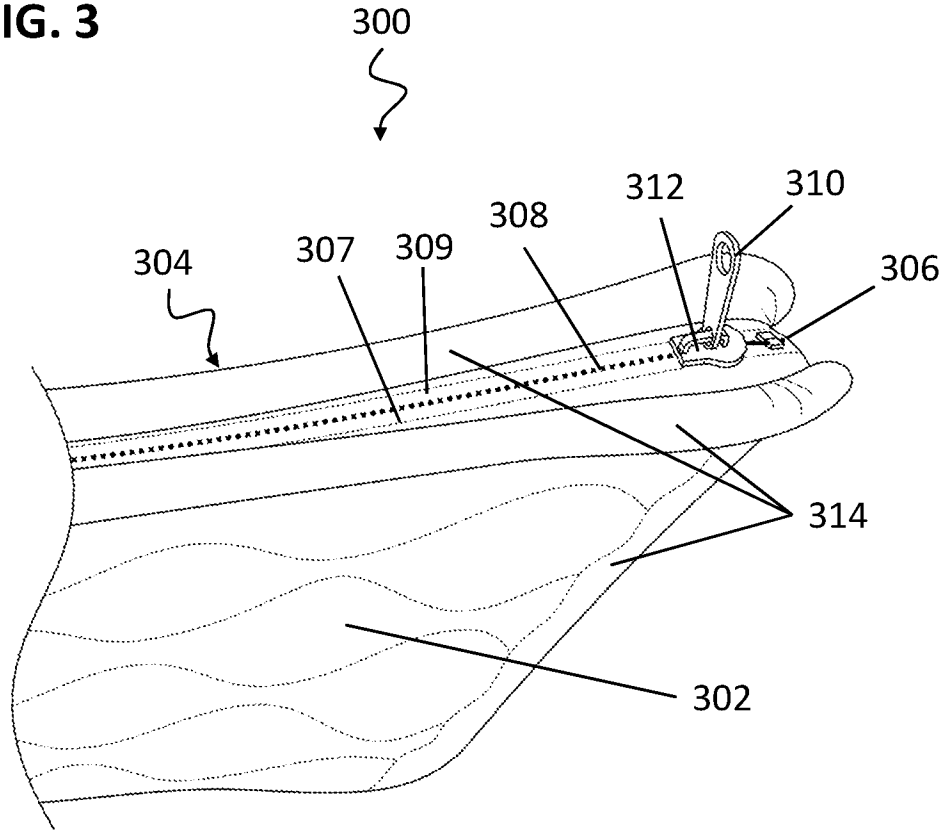
FIG. 3 shows a side expanded view of one embodiment of a glove or mitten showing the zipper attachment or joinder means.

In FIG. 3, one embodiment of an insulated glove 300 is shown detailing the attachment or joinder means used to connect the two half sections, the rear half section 304 (not shown but whose bias portion or edge is shown) and a front half section 302. Here, the attachment means used to reversibly connect and also to separate the two half sections (302, 304) into separate insulative units that can be used independently is a zipper 308, which has a first side (A) 307 and a second side (B) 308, each having a plurality of complementary spaced teeth that are interlockingly joinable by means of the zipper body 312, which acts to slidingly engage the first and second sides (A, B) of the zipper 308 into an integrated unit holding the two half sections together. In the embodiment shown in FIG. 3, the start of the zipper 308 is at position 306, where start tabs act to orient the two sides (A, B) of the zipper 308 so that the zipper body 312, aided by pulling on the zipper tab 310, can act to interlock the corresponding teeth of the two sides together when pulled in one direction (here to the left), and correspondingly, act to disengage and separate the zipper 308 when pulled in the opposite direction. Here, the outer bias portion or edging 314 also acts as a means for attaching the respective zipper halves, 307 and 309, of the assembled or joined zipper 308 to the corresponding front half section 302 and rear half section 304, which is preferentially attached adjacent to and slightly interior to said outer bias portion 314, so as to provide at least some distance of separation, preferably greater than the height of the zipper 308, between the zipper 308 and the exterior edge of the inventive glove to help prevent contact between a user's hand and the zipper 308, which may be exposed to extreme heat or cold during use. In the embodiment of the present invention shown in FIG. 3, the outer bias portion or edging provides sufficient spacing owing to its thickness so as to provide at least some distance of separation, preferably greater than the height of the zipper slider 312, between the zipper slider 312 and the exterior edge of the inventive glove to help prevent contact between a user's hand and both the zipper 308 and the zipper slider 312. In related embodiments, the outer seam 314 is of sufficient thickness or width to help prevent contact between a user's hand and either one of the zipper half sections 307 and 309 when the zipper 308 is in a separated state.

In another optional embodiment of the invention, a self-aligning zipper means that employs a set of magnets to initially align the two sides (A,B) of the zipper 308 is employed for ease of attachment, such means being disclosed in U.S. Pat. Appl. No. 2013/0061436 entitled "Self-Aligning Zipper", which is hereby incorporated in its entirety by reference.

In related embodiments, other means than a zipper can be used to detachably connect the two half sections (302, 304) of the inventive insulated glove, including a glider or slider as disclosed in U.S. Pat. No. 5,007,143 entitled "Rolling action zipper profile and slipper therefor", which is hereby incorporated in its entirety by reference. In embodiments employing a slider, the materials of construction are preferentially a heat resistant plastic, polymer or thermoplastic resin, that can withstand exposure to temperatures up to 500° F.

In other related embodiments, the use of complementary hook and loop connectors, such as for example, but not limited to Velcro™ and similar connection means which detachably interconnect by means of friction and entanglement between the complementary halves.

Figure 4:
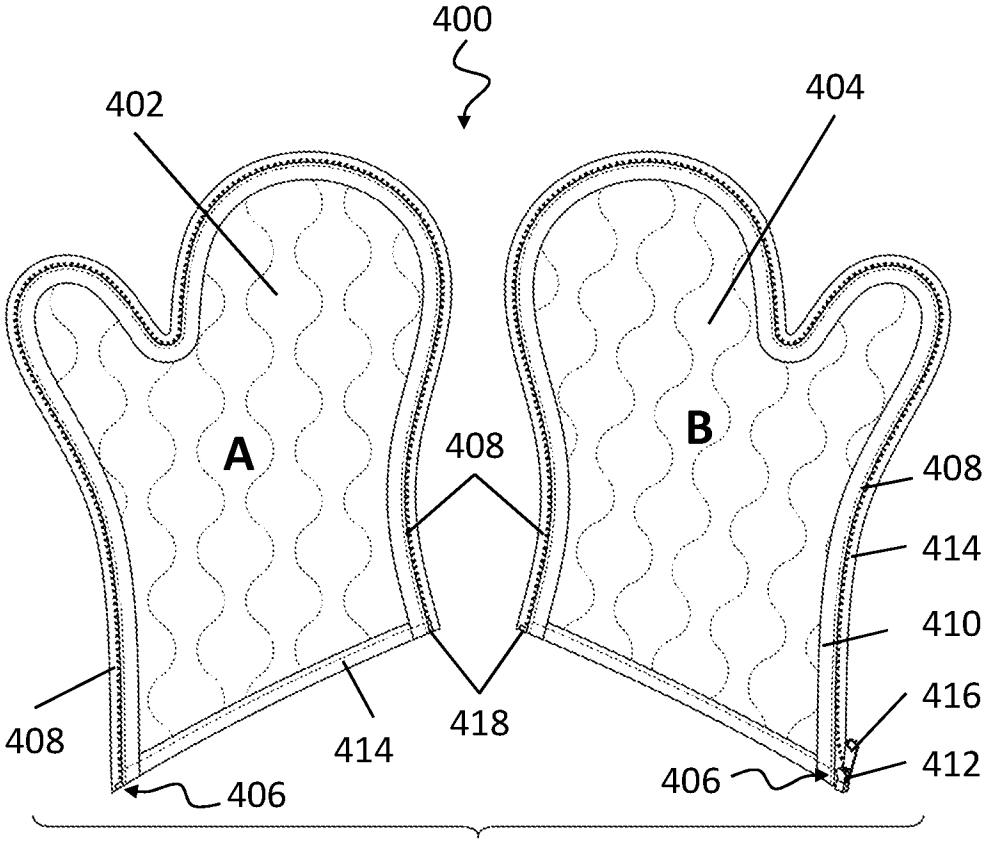
FIG. 4 shows an exploded view of one embodiment of a kitchen glove separated into two half sections illustrating the zipper attachment or joinder means.

FIG. 4 shows another embodiment of the invention featuring a short insulated glove 400 separated into its two corresponding half sections, a front panel 402 and a rear panel 404, which can be interconnectedly joined by means of the zipper 408, corresponding portions of the zipper 408 being sewn around the periphery of both half sections, with the zipper trace 408 having a starting position 406 featuring a zipper slider 412 with a pull table 416 to assist in the operation of the zipper, ending at the terminus of the zipper at position 418. The corresponding portions of the zipper are found on both panels 402 and 404, sewn along the bias portion 410 and immediately adjacent to the outer seam 414 of each of said panel, and slightly interior to the outer periphery of the panels to provide a small distance between the zipper 408 and the outer periphery of the glove represented by the outer seam 414 so that no portion of a user's hand or wrist can come into direct connect with the zipper in order to prevent heat transfer to the user of the inventive insulative glove.

FIG. 4 also illustrates one embodiment of the present invention in which the two separated half sections of the glove, the front panel 402 and rear panel 404, may be used as trivets or pads to protect a surface from a hot object, by placing one or both of said half sections on a surface intermediate between said surface and a hot or cold object, such as for example, but not limited to, a hot dish or hot object. Preferentially, when used as a trivet or pad, one or both of said half sections 402 and 404 are placed with the zipper 408 facing upward away from the surface, so as to prevent scratching or damage of the surface, and also to prevent any unwanted heat transfer between the zipper 408 and the surface being protected from the hot object.

Figure 5:
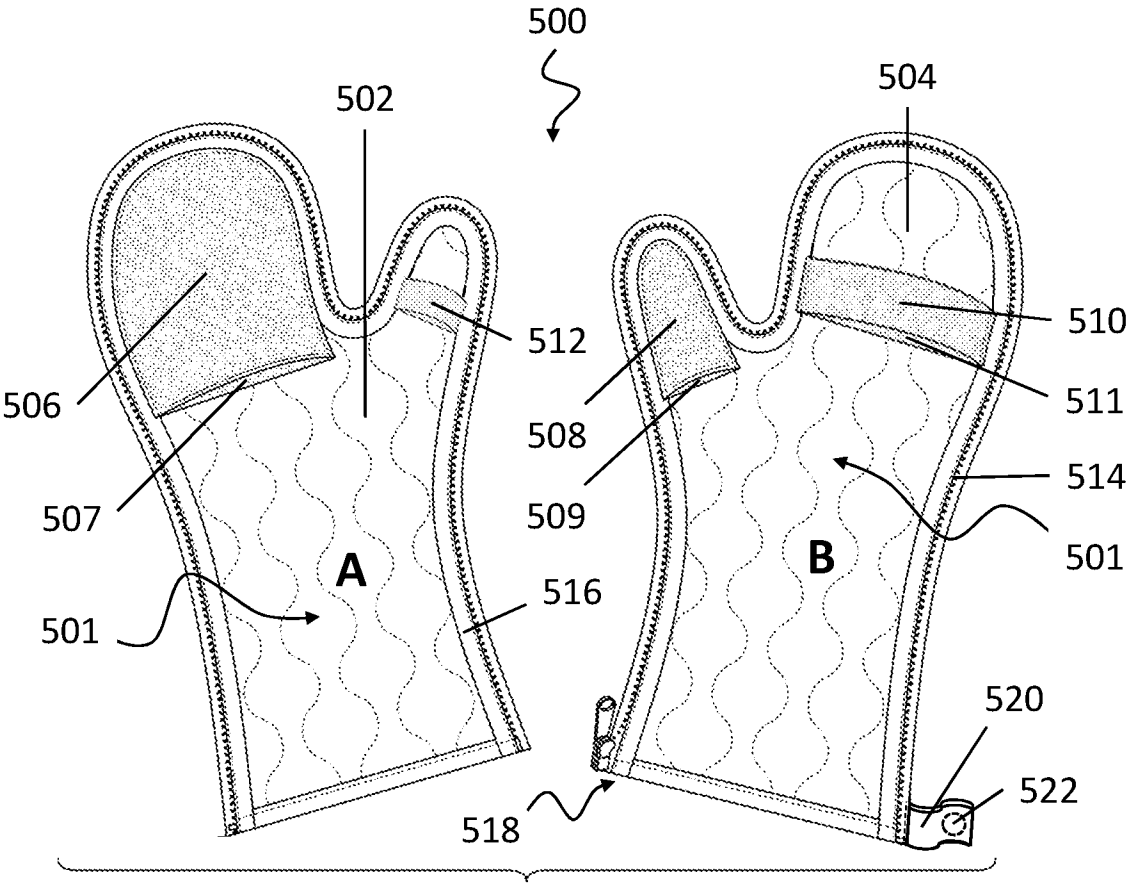
FIG. 5 shows an exploded view of two embodiments of a kitchen glove separated into two half sections illustrating the zipper attachment means and alternative finger and thumb pockets.

FIG. 5 shows another series of embodiments of the present invention in which additional features enabling one or more of the separated half sections of the glove to be worn as an individual mitt by a user enabled by means of additional pockets and sleeves attached to one or more interior regions of the glove in one or more cooperative configurations that are receptive to the inserting and engagement of a user's thumb, fingers and palm, and combinations thereof. In one embodiment, the a first halve 502 (A) of the glove has a finger pocket 506 attached along the curved periphery of the bias portion 516 of the glove that is immediately adjacent to and interior to the zipper trace, forming a pocket receptive to the insertion of one or more fingers of the user through the pocket opening 507. In this embodiment, the pocket is closed along the curved edges forming a pocket that not only enables holding the separated half section of the glove by means of one hand, but when the two half sections of the inventive glove are assembled by zipping together to form a whole glove, the finger pocket 506 enables a user the choice of insertion of one or more of their fingers inside the pocket 507 in order to have a better grip or fit, more readily accommodating use by different individuals having varying sized hands and fingers.

In another related embodiment of the present invention, a thumb sleeve 512 may be added to the interior 501 surface of a half section 502 of the glove, providing a means for the insertion and engagement of a user's thumb. In the particular embodiment shown in FIG. 5, the thumb sleeve 512 is attached on the left and right sides of the sleeve 512, respectively, created a through channel through which a thumb or finger can be inserted. In another related embodiment, a thumb pocket.

In FIG. 5, another embodiment of the present invention is shown featuring a thumb pocket 508, that is attached to the thumb portion of one separated half section 504 (B) of the glove, having an opening 509 to enable the insertion of a user's thumb, and attached along the remainder of its periphery to the bias portion 516 of the half section immediately adjacent to and interior to the zipper trace 514. In a related embodiment, a finger sleeve 510 with a through opening 511 that enables the insertion and passage of one or more fingers through the sleeve 510 to engage one or more of the user's fingers is also shown in FIG. 5, having only its right and left sides attached or sewn to the bias portion 516.

In another embodiment of the present invention (not shown), a palm sleeve 528 can be employed, position near the midsection, or middle region, or palm region 203 as shown in FIG. 2 hereinabove, of one or more of the separated glove sections, configured in a similar manner to the finger sleeve 510, but sized and positioned so as to engage the palm or portion thereof of a user's hand as inserted into the palm sleeve 528.

In another embodiment of the present invention (not shown), a wrist sleeve 530 can be employed, position near the lower or bottom side of one or more of the separated glove sections, configured in a similar manner to the finger sleeve 510, but sized and positioned so as to engage the wrist of a user's hand as inserted into the wrist sleeve 530.

In further embodiments of the present invention, any combination of finger, thumb, palm, and wrist sleeves and any combination of finger and thumb pockets, and combinations of sleeves and pockets may be combined on one or both of the two half sections of the glove as a means to enable the gripping and handling of the separated half section, or to improve the gripping and fit of an assembled glove with respect to a user's appendage, including their fingers, thumbs, hands, palms and wrists, and combinations thereof.

In a preferred embodiment, both of the halve glove sections of the present invention feature at least one of said finger, thumb, palm and wrist sleeves or pockets. In another preferred embodiment, each of the halve glove sections feature a complimentary sleeve or pocket that does not interfere with the insertion and retention of any portion of a user's appendage when the inventive glove is assembled by combining the respective half sections of the glove.

In the embodiments of the present invention disclosed above with respect to FIG. 5, the pocket and sleeve sections are attached to the inner surface of the respective halve glove sections in a manner that does not interfere with the attachment means used to join the two half sections together to form the integrated glove, generally being attached to the bias portion 516 of the glove sections, typically be sewing or adhesive to fix them in place. In some embodiments, the sleeve and pockets (506, 508, 510, 512, 528, 530) can consist of a single layer of fabric sewn around the periphery to the interior surface of the glove half sections (501), forming a pocket or sleeve by means of a single layer of material secured by some attachment means to the right and left side of said pocket or sleeve. In a closely related set of embodiments of the present invention, the pocket or sleeve may be configured as a double layer, loop or closed pocket of material secured around the periphery of said pocket or sleeve, leaving at least one opening for the insertion of an appendage. In another closely related set of embodiments of the present invention, one side, preferably the bottom side of the loop or pocket in direct contact with the interior side of the halve glove section 501 can also be attached or sewn along the opening, such as for example the finger pocket 506 opening 507 in which the lower (straight) edge of the finger pocket 506 is sewn to the interior surface 501 so that inserted fingers are guided directly into the interior of the finger pocket, 506, rather than going underneath the pocket as shown. Naturally, if only a single panel of material is employed, rather than a closed pocket, the opening edges of the sleeve or pocket are not sewn or attached to the interior surface 501, as the single panel of material itself acts to form a sleeve or pocket with respect to said interior surface 501, the left and right edges of the single panel of material being attached to the bias portion of the interior surface 501 of the respective half section of the glove thereby forming an open sleeve therewith.

In another embodiment of the present invention as illustrated in FIG. 5, the glove can also feature an additional fastening or securing means that enables the glove to be attached to a metal surface by means of a magnetic hanger 520 that has a small but strong magnet or super-magnet 522 present therein, such as for example, sewn into a pocket of the hanger 520 in the form of a closed loop of fabric that secures the magnet. In this manner, the half section or assembled glove can be suspended on the side of a refrigerator, stove, BBQ or other appliance or metal surface by means of magnetic attraction, so that the gloves are easily stored between use and can be conveniently located close to a stove or BBQ when needed. Such a magnetic hanger 520 is preferentially located on at least one of the half sections, and located near the wrist section or near the bottom of the glove so as not to attach to a metal object that is being manipulated by the glove or half section of the glove during use. In another embodiment, both of the half sections of the glove can have a magnetic hanger 520 attached, at a complementary position to interact with one another by magnetic attraction to form a single magnetic hanger 530 when combined, by means of the two magnets of the individual half section's magnetic hangers 520 being located adjacent to one another when the glove is combined into a single unit, or alternatively in another inventive embodiment by locating them at a distant position with respect to one another, to form two separate magnetic hangers 520 even when the glove is combined into a single unit, either of these embodiments enabling the separated half sections to each have their own magnetic hanger 520.

In a related embodiment, another hanger means 526 (not shown) in the form of a loop similar to loop 220 as shown in FIG. 2 can be located near the wrist section of near the bottom of the glove or at least one half section thereof, as a means of hanging them from a hook or peg or other support means. Further, in another related embodiment of the invention, a hanger in the form of an open "?" or hook 527 (not shown) made of a resilient material capable of holding its shape and that can be attached by any suitable means to the glove or a half section thereof, to enable hanging or securing of the glove from a stationary peg or hook that can accommodate the hook 527, used either alone or in combination with any other disclosed hanging means or means known in the art.

In other related embodiments of the present invention as shown in FIG. 5, the glove can include any one or combinations of a sleeve or pocket feature as disclosed, configured to allow the insertion and engagement of any one or more of a user's appendages, including a finger, a thumb, a combination of fingers, a combination of fingers and thumb, and a user's palm, a user's wrist and any possible combinations thereof, for the purpose of engaging one or more of a user's appendage to enable the secure handling and retention of the inventive glove to a user's appendage as a separated half section during use, or to improve the fit and gripping strength of a user employing the inventive glove as an assembled whole. In one embodiment, perhaps best saved for emergency use only, the inventive glove or one or more half sections thereof can be fitted onto or secured to one or more feet of a user, to enable passage across an extremely hot or cold surface, so as to protect at least the bottom of a user's foot, or a user's foot in traversing a hot bed of coals, for example.

Figure 6:
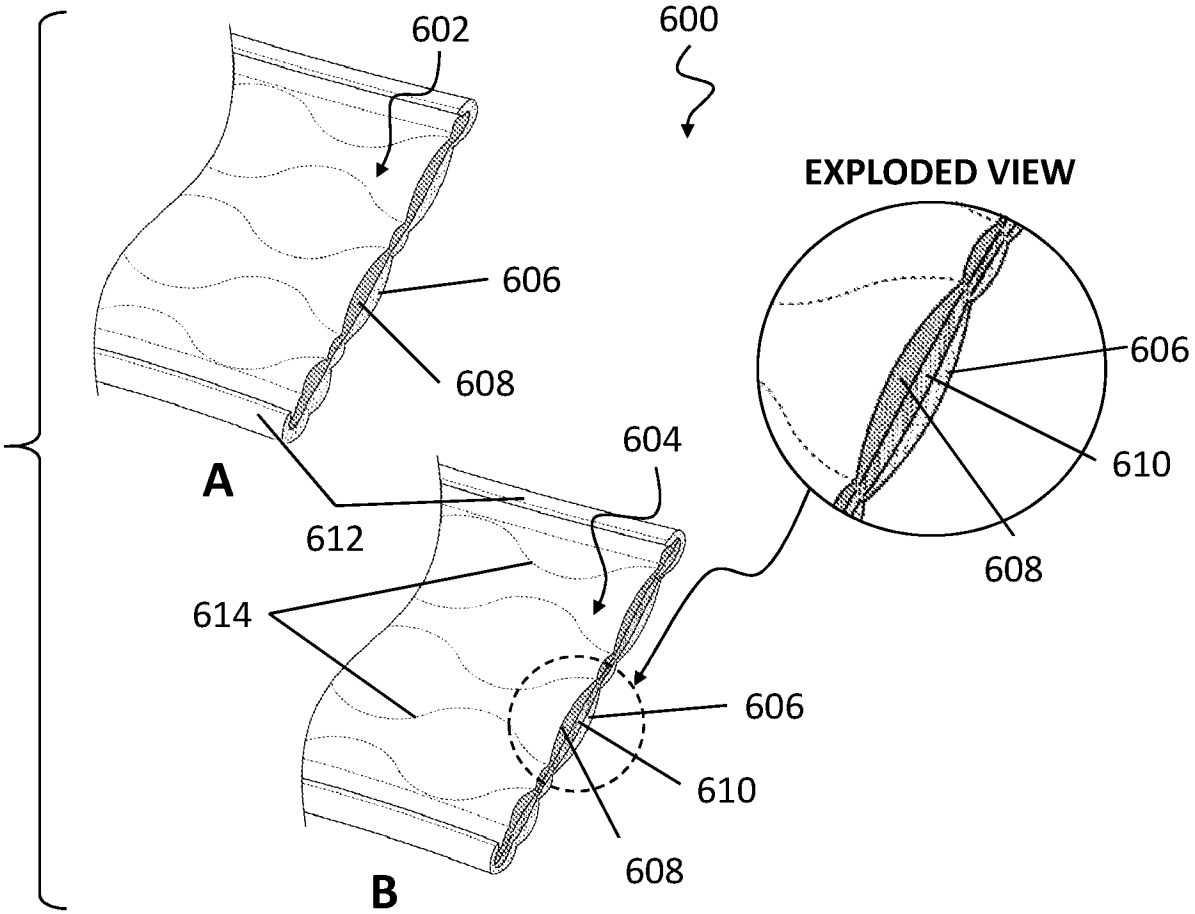
FIG. 6 shows a cross-sectional view of two embodiments of a glove or mitten illustrating the form and materials of construction of an insulating panel, including an expanded view thereof.

In FIG. 6, various embodiments of the present invention are shown with respect to the construction of the glove panels, the panel 600 being optionally constructed of a single layer panel 601 (not shown) of material, a dual layer panel (602), a triple layer panel (604) and optionally a multilayered panel (605), not shown, depending on the nature of the material, including the type, thickness, insulative properties, and other functional aspects selected in order to provide the inventive glove with the necessary insulative, mechanical and physical properties needed for a particular task.

In embodiments of the present invention using a single layer panel 601, the single layer is typically selected from a material that is insulative in nature, yet has a surface finish that resists the penetration of liquids and soils, such as for example including, but not limited to, foam, closed-cell foam, micro-cell foams, and the like that are commercially available, and optionally available with a thin coating of a water and oil-resistant material. In these embodiments, only a single layer is required for construction of the inventive glove panels, the thickness of the foam materials being selected to provide the necessary degree of thermal insulation required to protect a user's hand on one side from extremes of hot and cold on the other side of the material.

In embodiments of the present invention using a double layer panel 602, as shown in FIG. 6 A, a first exterior layer 606 is combined with a second interior layer 608, the two layers being selected from the same material or from different materials. If both are the same material, they may be selected based on the same characteristics as those of a single panel, the combination of the two mainly being chosen in these embodiments to provide an additional quilting effect as described herein, which produces air pockets that increase the insulative value of the panels, as well as mechanically providing a surface texture that improves the ability of the exterior surface of the glove to grip and hold objects with less tendency to slip.

In embodiments employing a double layer panel 602 wherein the two layers 606 and 608 are selected from different materials, the exterior layer 606 may be selected from materials that have desirable properties for an exterior side, such as water and oil-resistance, improved gripping ability, texture or some other beneficial coating or treatment applied thereon, either to both sides of the exterior layer 606, or only its outward facing anterior side that would come into contact with an object held by the user of the inventive glove. In these embodiments discussed immediately above, the interior layer 608 may then be selected for properties desirable for contact with the user's hand or digits, including increased insulative value, softness, reduced friction, and other factors relating to comfort and hand feel experienced by the user. In yet another related embodiment of the present invention, the interior layer 606 and exterior layer 608 may be selected from a single anterior coated or treated insulative material, wherein the anterior treated surfaces of both panels are combined so as to position the respective anterior treated surfaces to face the exterior and interior surfaces of the panel, or said alternatively, positioned so that the untreated interior surfaces mate, providing both the exterior and interior surfaces of the glove panel with the benefit of the treated surfaces.

In embodiments of the present invention employing a triple layer panel 604 as shown in FIG. 6 B, even greater versatility in the selection of the three material layers is provided, so that insulative properties of the constructed triple layer panel 604 can be selected independently from the properties of the individual layers including the exterior layer 606, the interior layer 608 and the intermediate layer 610, as more clearly illustrated in the Exploded View inset provided. In one embodiment, the intermediate layer 610 is selected for its insulative value, while the interior and exterior layers, 608 and 606, are selected for user comfort and hand feel, and stain-resistance, grip and texture, respectively. In further related triple layer embodiments of the present invention, the individual layers may be selected from materials with properties as discussed immediately above, selection being done to combine the desired properties to be exhibited by the exterior surfaces and the interior surfaces of the panel of the glove as desired for its intended application.

In yet a further embodiment of the present invention, additional layers of four or more materials can be combined as desired, with or without a treatment or surface treatment applied thereon, in any order, and attached to one another by any means, or not attached but quilted together to form an integrated panel for manufacture of the inventive glove.

In all of the single and multiple layered embodiments discussed above, the quilting of the panel by means of a threaded trace 614 is desirable, but not required, for improving the appearance and gripping strength of the panels of the inventive glove employing these materials. Although a threaded trace 614 is shown in FIG. 6, other embodiments of the invention include forming a quilted pattern by means including, but not limited to, bonding, pressure bonding, thermal bonding, compression entanglement, and other such means as known in the art to bond two adjacent fabric or textile or polymer films together at least one position.

In addition to those physical and mechanical features and properties disclosed hereinabove relating to the various embodiments of the inventive glove, additional functional features can be employed to improve the performance, handling, cleaning and functionality of the inventive glove. Such functional features include, but are not limited to, treatments applied to one or more of the fabric panels or materials of construction used therein, to provide properties selected from antimicrobial activity, soil resistance, stain resistance, water and oil resistance or repellency, odor control, easier cleaning, faster drying, gripping improvement, and combinations thereof. Treatments and other functional adjuncts that may be used or included in the construction of the panel materials used in making the inventive gloves are discussed in more detail below, as well as insulative materials useful in providing the desired insulative value (R) to the panels.

Construction Details

In one embodiment of the present invention, the two halve sections of the glove are in the form of an approximate mirror-imaged shape with respect to one another, represented by a complementary top and bottom section or half section, which when placed together in an overlapping or coinciding coplanar horizontal position, can be joined together along one outer edge or at least one selected region along said outer edge, by some joinder means capable of attaching the two regions together, to form an integrated glove structure with an internal opening capable of allowing the insertion and retention of at least one or more fingers of a user's hand, or a portion of a user's hand including fingers and thumbs.

In a related embodiment to that disclosed immediately above, the two halve sections of the glove share at least one mirror-imaged shaped section or complementary region enabling joinder of the two half sections to form an integrated structure with at least one common point of attachment or at least one attachment region shared by both of the half sections, forming a planar, open structure that can be positioned to lie flat on a horizontal surface to serve as an insulating trivet, when joined in either fashion. Either of these embodiments has the advantage of producing a connected set of trivets that will stay together and not move apart or become displaced from one another when used to protect a surface from a hot or cold object placed thereon.

In a further related embodiment to that disclosed immediately above, the assembled glove with two connected half sections present may subsequently be completed separated and the two half sections detached from one another to form two physically separate and displaceably separable insulated units, which can themselves be used as individual insulating mitts worn on a hand, or used as two independent insulating trivets.

In the embodiments of the invention disclosed herein, a bias portion or edging feature is desirable along the outer periphery of the half sections of the glove to provide a region along the periphery of the glove to position the attachment or joinder means, such as for example, but not limited to, a zipper or band of hook & loop fastener. Further, the bias feature is desirable to close the otherwise open end of the panel section, particularly in layered constructs, so that the raw edge of any fabric or textile sheet thus employed is not exposed along its periphery. In one embodiment, the bias portion is simply a loop of the fabric or textile sheet material bent back on itself and secured by some means, such as by sewing or bonding, as described herein with regard to the means of producing a quilted pattern in said panel section. In preferred embodiments, the width of the bias portion or edging feature is wide enough to accommodate the attachment of a fastening, attachment or joinder means, such as for example a zipper or band of hook & loop fastener, or some other attachment or joinder means. In some embodiments, the bias portion or edging feature is immediately adjacent and narrowly separated with respect to the periphery of the half section of the inventive glove, while in preferred embodiments, the bias portion or edging feature is immediately adjacent and more widely separated with respect to the periphery of the half section so that when the attachment means is present on the bias portion, the outer edge of the attachment means, for example being a zipper, is more widely separated from the periphery so that at least a small gap is present so that when the two corresponding half sections of the inventive glove are combined, the attachment or joinder means (zipper) does not protrude beyond the periphery of the assembled glove in the first instance, and is further indented or slightly internal to the periphery of the assembled glove in the second, preferred instance. In the preferred embodiment thus described, a metal zipper would be at least slightly internally displaced along the bias portion so that no part of the zipper in either half section or in the assembled glove would protrude or be near the outer periphery of the half section or glove, reducing the chance of contact between the metal zipper and a user's hand, thus avoiding the chance of a user's hand or appendage thereof touching the zipper during use, because metal materials are well known heat and cold conductors and being located on the periphery could reasonably be expected to be exposed to the heat or cold source during use.

However, in embodiments employing non-metallic attachment means, including hook & look fasteners and plastic zippers, for example, the attachment or joinder means can be placed immediately adjacent to, and even positioned to slightly protrude beyond the periphery of the half section or assembled glove, as there would then be a much lesser danger of undesirable heat or cold transfer to a user's hand or appendage owing to the attachment or joinder means.

Joinder Means

In one embodiment of the present invention, the two half sections of the glove are in the form of a mirror-imaged shape with respect to one another as described herein, with complementary outer edges capable of being reversibly joined, and which are joined together at least at one position along said outer edges, by an attachment (joinder) means capable of at least holding the two half sections together during physical manipulation as a glove or as a trivet. In a related embodiment of the present invention to that described immediately above, the two half sections of the glove are not mirror-imaged shapes but have at least on complementary outer edge or a portion thereof that is capable of being reversibly joined together by said joinder means, sufficient to hold the two half sections together during physical manipulation as a unit, such as for example but not limited to, a trivet, pot holder, tray holder, placemat, and the like.

Suitable joinder means include common approaches disclosed in the art such as, but not limited to, buttons, Velcro™ (a product of the 3M Company, located at 3M Center, St. Paul, Minn. 55144-1000, USA), hook-and-loop complementary fabrics, friction seams, magnets, magnets and keepers, snaps, ties and zippers, and combinations thereof.

In one embodiment of the present invention, a zipper is used as the joinder means, one section of the zipper trace being attached to the peripheral area of a first halve of the glove and the second complementary section of the zipper trace with the securing pull tab present being attached to a second peripheral area of the second complementary halve of the glove, in a position enabling the joining of the two sections of the zipper trace to be interconnected by means of sliding the securing pull tab from a first engagement position to an intermediate or terminal position, wherein the securing pull tab acts to interweave the corresponding teeth of said two sections of zipper trace into an interconnected unit.

The zipper can be made from any suitable material or combination of materials, including metal, plastic, polymers, resins, and combinations thereof. The zipper can be cut, formed, molded, cast, forged, pressed or be made by any known manufacturing method. The attachment of the zipper to one or more panels of the glove can be done by means of sewing, gluing, bonding or the use any suitable bonding technique or any combination of techniques, such as for example, but not limited to, thermal and compression melt bonding. In preferred embodiments, the zipper is heat resistant and made from a material of construction chosen that will not significantly soften or melt at temperatures up to about 500° F.

Friction seams include those molded, complementary barb and channel style reversible fastening means used with or without sliders on the plastic panels of Ziploc™ storage bags (Ziploc™ products available from S.C. Johnson & Sons, 1525 Howe Street Racine, Wis. 53403-5011, USA and shown, for example in U.S. Pat. No. 7,029,178 entitled "Zip-lock closure", which is hereby incorporated in its entirety by reference) and to enable (re)closing of the bags. In preferred embodiments, the friction seam components are heat resistant and made from a material of construction chosen that will not significantly soften or melt at temperatures up to about 500° F.

Magnets and keepers include a patterned combination of at least one magnet and at least one ferrous or iron-containing metal object that is attracted to said magnet forming a reversible coupling. In inventive embodiments employing magnets and keepers, a plurality of each are patterned in such a manner as to enable a desired coupling overlap so that select portions of each halve of said glove bearing said plurality of magnets and keepers is joined in a manner complementary to said pattern, so that the two half sections of the glove removably connect to each other by magnetic attraction but only in a manner consistent with said pattern, so that the combined whole glove is configured by joining to form a desired and consistent glove. For example, the pattern ensures that the thumb portions and finger portions of the complementary half sections join together properly to form a pocket for a thumb or at least one finger of the user, and variations thereof.

In some embodiments of the present invention intended for the handling of higher temperature extremes of hot and cold objects, the presence of exposed metal components may product heat or cold conductive sites that might produce discomfort or injury to the user, so that in these instances, a joinder means such as a zipper or snap is preferably present in the form of a non-metallic connector, such as for example, but not limited to, plastic, polymer, resin or composite materials of construction with lower heat conductivity or transmission than a typical metal such as iron, brass, copper, steel or the like. In embodiments employing magnets and metallic keepers, one preferred option is to have the metal element coated, covered by a fabric panel of the glove, or covered by an additional fabric element so that the surface of the magnet or metallic keeper is protected from direct contact with an object or the skin or flesh of a user of the glove, so as to prevent or reduce heat transfer through the metal element. In one embodiment, magnets and metallic keepers are coated with a thin coating of an adherent plastic, polymer or silicone film that is resilient but provides a heat insulating barrier to the metallic element.

In other embodiments of the present invention, one or more magnets or one or more sets of magnet and keepers can be employed solely for the purpose of facilitating the proper complementary positions of the two initially separated half sections of the glove into a mutually aligned position in which the start of the two zipper traces are approximately aligned in a position from which they can then be more easily interconnected at the start of the zipper trace, as well as facilitating the interlocking of the two zipper traces as the zipper pull tab is progressively moved along the zipper trace located along the bias portion located near the outer periphery of the two half sections of the glove to form the assembled glove, leaving the unattached remaining portion (opening) of the assembled glove open to enable hand insertion.

Materials of Construction

Materials of construction suitable for use with embodiments of the present invention include natural and synthetic fibers in the form of thread, woven and non-woven fabrics and textiles, and constructs of said textiles, combined to form the panels, sleeves, pockets and compartments of the glove as disclosed herein. Other materials of construction suitable for use herein include those selected for their insulative value (R), being the resistance to the transmission of heat or cold through their cross-section. Materials of construction described in more detail hereinbelow include those materials suitable for both covering the panels of the inventive glove and in providing insulative value to the panels of the glove. Materials of construction described herein also include those materials used to produce the sleeves and pocket accessories as described in one or more embodiments of the present invention, as well as other features, such as attachment loops and means thereof, which are typically in the form of a single sheet or layer of a fabric material or textile.

Natural fibers and materials include, but are not limited to, cotton, hemp, silk, rayon, wool and other similar plant and vegetable derived materials that are suitable for forming fibers and threads, and of being subsequently formed into stitched, woven, knitted, knotted, yarned or otherwise entangled planar sheets of textile or cloth panels. In other embodiments, insulative materials for use herein may be selected from, but not limited to, cellulose, glass wool, rock wool, vermiculite, perlite, wood fiber, plant fibers such as cannabis, flax, cotton, cork, etc., recycled cotton denim, plant straw, animal fibers such as sheep's wool, lamb's wool, etc., and combinations thereof.

Synthetic fibers and materials include, but are not limited to, polymers and copolymers that are produced by chemical means, and which can be mechanically or heat treated to form fibers and threads, and which are subsequently formed into stitched, woven, knitted, knotted, yarned or otherwise entangled planar sheets of textile or cloth panels, or alternatively may be formed into entangled planar sheets by non-woven means including air laid, water laid, electrostatic or dynamic fiber entanglement means when the source fiber is process directly in a partially softened, flowable or melted state in the form of said source fiber, by means of any suitable process common in the art. Non-limiting examples of suitable synthetic materials include nylon, polyester, polyacrylamide, and the like, as well as other synthetic polymers known in the art such as fluorocarbon and silicone based materials such as Teflon™ (a registered trademark of the Dupont Company), perfluoropolyethylene, polysiloxane, silicones, and the like.

In addition, embodiments of the invention can employ materials of construction that have been optionally treated by a second material or process, such as for example, but not limited to, a chemical material or compound, reactive species, coating, treatment process, such as exposure to heat, plasma or ionizing radiation, in order to provide a secondary benefit to said materials. Such second material classes that can provide such secondary benefits include, but are not limited to antimicrobials, disinfectants, anti-soiling agents, odor control agents, oil and water repellants, gripping aids to prevent slippage, and combinations thereof. Such treatment processes include those employing exposure of the outer surface of said materials of construction by means of heat, plasma or ionizing radiation in order to alter the surface properties in a favorable way to achieve a benefit as described herein.

In embodiments of the present invention, planar sheets of textile or cloth panels are used singly or in combination to form the walls and gripping surfaces of the glove. One or a plurality of panels are suitably employed, the nature and thickness of the panel(s) being selected for the application. In general in most embodiments, better heat and cold resistance is achieved by increasing the thickness of the panel to achieve some minimum insulation value, denoted by the heat transmission or insulative factor, R.

In other embodiments of the present invention, multiple sheets of textiles or panels are combined into a construct with at least one exterior layer and at least one insulating layer in contact therewith, wherein the purpose of said insulating layer is to provide the insulation value of the construct while the exterior layer is selected to primarily provide a covering means, and secondarily to provide one or more secondary benefits as described herein.

In one embodiment of the present invention, a single layer of material having sufficient insulating properties may be employed to form one or more panels of the glove or portion thereof. Materials having suitable insulating properties in sheet form include, but are not limited to, batting, down, foam, feathers, fluff, fleece, fuzz, lint, eiderdown, feathers, floss, sponge and combinations thereof, including both naturally derived and synthetically manufactured versions thereof. These preceding materials may be present in a layered construct, or present as bits or pieces of the materials assembled or compressed to form a bulk collective thereof suitable for encapsulation by one or more layers of a second material that can hold or trap in place the assembled or compressed form of the insulating materials. In preferred embodiments, the insulating material is selected to have a high heat and cold insulation factor, R, wherein higher values of R correspond to greater insulative properties.

In other embodiments of the present invention, materials used for their insulative properties include foams, microfoams and closed-cell foams make from polymeric materials that may be selected from, but not limited to, ethylene-vinyl acetate (EVA) foam, the copolymers of ethylene and vinyl acetate; low-density polyethylene (LDPE) foam, polyethylene (PE), nitrile rubber (NBR) foam, the copolymers of acrylonitrile (ACN) and butadiene, polychloroprene foam, neoprene, polyimide foam, polypropylene (PP) foam, including expanded polypropylene (EPP) and polypropylene paper (PPP), polystyrene (PS) foam, including expanded polystyrene (EPS), extruded polystyrene foam (XPS) and polystyrene paper (PSP), styrofoam, including extruded polystyrene foam (XPS) and expanded polystyrene (EPS), polyurethane (PU) foam, low-resilience polyurethane (LRPu), memory foam, sorbothane, polyvinyl chloride (PVC) foam, closed-cell PVC foamboard, silicone foam, microcellular foam and other polymer and copolymer materials that can be blown into an open or closed-cell cellular foam structure with some degree of flexibility suitable for the manipulation of objects when constructed as a glove panel according to the inventive disclosure herein.

The materials of construction can be employed in any desired thickness, combined and layered in any suitable pattern or combination of layers, and can include treated materials as discussed hereinbelow to provide additional functional properties in addition to a least one insulative property.

In alternative embodiments of the present invention, one or a plurality of layers of an insulating material can be employed to raise the R value of a glove panel.

In other embodiments of the present invention, insulating material of various thickness or bulk can be covered by a first, or alternatively, first and second outer layer, to form an encapsulated insulated construct in which the insulating material is protected by said first or first and second outer layer.

In another embodiment of the present invention, a plurality of layers of material having sufficient insulating properties may be layered or otherwise combined in a manner to form one or more panels of the glove or portion thereof.

In another related embodiment of the present invention, a layer of insulating material can be combined with one or more additional layers of a panel material, such as a sheet of textile or cloth, attached to at least one side or on both sides of said insulating material layer, to protect said insulating material from direct contact or exposure to objects in contact with the glove. In embodiments of the present invention employing this optional construction approach, this single layering or sandwich layering enables any insulating material layers present in these embodiments to remain clean and not be directly exposed to liquids, foods or soils during use.

In a further embodiment of the present invention, one or two layers of an exterior sheet of textile or cloth can be joined to one side or two sides, respectively, of a layer of insulating material by some attachment or connection means, including but not limited to, processing such as gluing, thermal bonding, quilting, sewing, stitching, tacking and combinations thereof.

In a preferred embodiment, quilting of a layered insulating material enables the formation of hills and valleys, being the high loft and low loft points where the sewn quilted construction is either free of stitching or is stitched, respectively. This embodiment of the present invention adds thickness to the layered insulating material construction, and produces an additional insulating effect by means of forming multiple air channels or paths corresponding to the stitched pattern that traps air when the surface of the layered construct is brought into contact with a hot or cold object. A further advantage of a quilted layered insulating construction is to increase surface friction and thereby improve the gripability of the material, that is to aid the ability of the user of the assembled glove or one or more unassembled glove half sections to pick up and hold onto objects without slippage.

Pockets for engaging one or more of a user's appendage, including one or more fingers, thumb, palm and wrist, and combinations thereof as disclosed hereinabove in embodiments of the invention relating to those discussed with FIG. 5, may be constructed of any suitable material, fabric, textile or combination thereof. In one embodiment, a cotton fabric is employed, while in another embodiment, an elastomeric material or textile with elastomeric properties that have some degree of stretchiness and recovery is employed in order to enable an intimate fit and contact with the inserted appendage.

Material Treatment Means

In some embodiments of the present invention it is desirable to treat the surfaces of the glove, including the exterior (outer) and interior (inner) surfaces thereof, by some treatment means capable of providing the treated surface with an additional benefit or functionality.

In one embodiment, a stain or soil resistant finish may be applied in order to reduce or prevent the staining of the glove by foods, liquids and other residues encountered during use. Conventional stain and soil resistant and stain-proofing treatments known in the art are quite suitable for use with the present invention, including such treatment materials based for example, but not limited to, on hydrocarbons, fluorochemicals, silicones, polysiloxanes, siloxanes, polymers, copolymers, waxes, and combinations thereof.

These and related materials known in the art may be employed alone, or in combination, to achieve one or more functional benefits selected from, but not limited to, as easier cleaning, stain and soil resistance, water and oil resistance and/or repellency, antimicrobial or odor control efficacy, faster drying, gripping improvement, and combinations thereof.

In one embodiment, the panels used to construct the present invention, or at least the surfaces of said panels or materials of construction, are treated with a colloidal or nano-particle based silver biocidal agent or treatment means that provides some degree of odor control, biocidal efficacy and/or antistatic and anti-microbial benefit to the inventive glove.

In other embodiments of the present invention, it is desirable to apply a flame-resistant or flame-retardant material to one or more surfaces of the glove, or to materials of construction including the insulation, fabric layers, thread, yarn and other absorptive materials used, suitably using those flame-retardant materials know in the art, and most preferentially employing those that are safe for use around foods, food contact items and humans.

In further embodiments of the present invention in which a treatment means is applied, the treatment agent can be applied to the materials prior to construction, or alternatively, applied after construction of the glove, or in parts prior to and after construction of the glove, as desired to maximize the desired benefit while reducing the amount of treatment agent needed. In these embodiments, the treatment agent can be applied by any appropriate means as required to affect the treatment, such as for example, but not limited to, application by means of a gas, liquid, or solid treatment agent applied to said construction materials by means appropriate to said treatment agent, including but not limited to, dipping, infusion, melt, submersion, spraying or wet-laid contact methods commonly known in the art.

In one embodiment of the present invention, materials of construction of the glove used to produce the panels maybe treated with an agent that can reduce, control, eliminate or prevent the growth of microorganisms, including for example, but not limited to archaea, bacteria, fungus, mildew, mold, microbes, prions and viruses.

The above illustrations provides many different embodiments or embodiments for implementing different features of the invention. Specific embodiments of components and processes are described to help clarify the invention. These are, of course, merely embodiments and are not intended to limit the invention from that described in the claims.

Although the present invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed:

1. An insulative glove comprising: a front section including a body portion, a thumb portion and one or a plurality of finger portions; a rear section including a body portion, a thumb portion and one or a plurality of finger portions; wherein said front and rear sections each include a reversible joinder means capable of removably attaching and securing said front and rear sections together; wherein said joinder means is positioned immediately adjacent a bias portion located said bias portion comprises an edging located on a periphery of said front and rear sections; wherein said joinder means is configured to enable said front and rear sections to be reversibly attached to one another along said bias portion to form an integrated unit; wherein said front and rear sections are joined to form an integrated unit including at least one hand receiving region and a thumb region, and optionally one or more of a plurality of finger regions, a palm region and a wrist region; and an open region for insertion of a user's hand or appendage thereof into said hand receiving region; wherein said front and rear sections are constructed of at least one layer of a thermal insulative material; and wherein said front and rear sections may be separated and detached from one another to form a plurality of either a mitt or a trivet when said sections are not joined together as an integrated unit, wherein at least one of said front or rear sections further comprises one or a plurality of a sleeve selected from a thumb sleeve, finger sleeve, palm sleeve, hand sleeve, wrist sleeve and combinations thereof; wherein said sleeve is a partially closed region in the form of a loop secured at both ends thereof with at least two openings for insertion of said appendage including a thumb, finger, palm, hand and wrist; and wherein said sleeve is attached to the inside or interior region of said front or rear section.

2. An insulative glove comprising: a front section including a body portion, a thumb portion and one or a plurality of finger portions; a rear section including a body portion, a thumb portion and one or a plurality of finger portions; wherein said front and rear sections each include a reversible joinder means capable of removably attaching and securing said front and rear sections together; wherein said joinder means is positioned immediately adjacent a bias portion, said bias portion comprises an edging located on a periphery of said front and rear sections; wherein said joinder means is configured to enable said front and rear sections to be reversibly attached to one another along said bias portion to form an integrated unit; wherein said front and rear sections are joined to form an integrated unit including at least one hand receiving region and a thumb region, and optionally one or more of a plurality of finger regions, a palm region and a wrist region; and an open region for insertion of a user's hand or appendage thereof into said hand receiving region; wherein said front and rear sections are constructed of at least one layer of a thermal insulative material; and wherein said front and rear sections may be separated and detached from one another to form a plurality of either a mitt or a trivet when said sections are not joined together as an integrated unit, wherein said front and rear sections comprise thermal panels of an insulative material; wherein said thermal panels are selected from a single layer, double layer or triple layer of said insulative material; and wherein said layer of insulative material has an R value of between 1.0 to 20 when combined into three or more layers; or alternatively between 1.0 to 10 when combined into two or more layers; or alternatively between 1.0 to 5 when using a single layer thereof.

3. The insulative glove of claim 2 wherein said thermal panels of insulative material are quilted across their cross-sections to form a quilted surface pattern on at least one exterior side of at least one of said front or rear sections; and wherein said quilted surface pattern provides at least one of either an improved gripping ability and increased insulative value of the exterior side of said thermal panels.

4. The insulative glove of claim 2 wherein said thermal panels of insulative material comprises 100% cotton.

5. The insulative glove of claim 2 wherein said thermal panels of said front or rear sections of one or more layers of said insulative material are joined along their perimeters to form a bias portion that is located immediately adjacent to the outer periphery of said sections and inside the outer perimeter of said seconds; and wherein said bias portion may be in the form of a seam, hem, double hem, triple hem, bonded region, compressed region or combination thereof.

6. The insulative glove of claim 2 wherein at least one exterior side of at least one thermal panel has been modified to exhibit an additional beneficially property; wherein said modification is performed on at least one layer of said panel by a treatment mean applied either to said panel or to at least one surface of said panel; wherein said treatment means provides at least one beneficial property selected from anti-static, easier-cleaning, grip or friction enhancement, flame resistant, water-repellency, oil-repellency, soil resistance, stain resistance, antimicrobial resistance, germicidal activity, odor control, antistatic properties, and combinations thereof.

7. The insulative glove of claim 6 wherein said treatment means comprises use of a treatment agent applied to at least one layer of at least one said panel by means of dipping, soaking, spraying, rolling, pressing or bonding, or a combination thereof; and wherein said treatment agent is selected from a bonded abrasive, friction coating, polymer, copolymer, silicone resin, fluoropolymer, perfluorinated copolymer, mineral, polysiloxane, quaternary biocide, silver biocide, silver nanoparticles, resin, wax, and combinations thereof.

8. The insulative glove of claim 7 wherein said treatment means is applied to at least one exterior surface of at least one said thermal panel; wherein said treatment means is applied in a non-continuous manner in the form of a pattern of dots, lines, squares, squiggles, and other similar geometric patterns; wherein said treatment means is present as a discreet coating disposed on the surface of said thermal panel; and wherein said treatment means provides improved grip and friction enhancement to said surface of said panel compared to an untreated surface.

9. The insulative glove of claim 1 wherein at least one of said front and rear sections further includes a hanging means attached to at least one position along said bias portion thereof; wherein said position disposes said hanging means to the exterior of said integrated unit when said front and rear sections are joined together; and wherein said hanging means is selected from a loop, hook, magnetic loop, magnet and combinations thereof.

10. An integrated tool system comprising a convertible insulated glove comprising a first section and a second section; wherein said first and second section share a complimentary joinder means located immediately adjacent a bias portion of each of said sections enabling said two sections to be combined into an integrated unit joined along the bias portion, the bias portion comprises an edging on the first and second sections and is located within the periphery of said integrated unit with at least one portion defining an opening capable of receiving a user's hand or appendage;

wherein at least one of said first or second section further comprises either one of: (i) at least one or a plurality of a pocket selected from a thumb pocket, finger pocket, palm pocket, hand pocket, and combinations thereof; wherein said pocket is a partially closed region with at least one opening for insertion of said appendage including a thumb, finger, palm, and hand; and wherein said pocket is attached to the inside or interior region of said front or rear section, or (ii) at least one or a plurality of a sleeve selected from a thumb sleeve, finger sleeve, palm sleeve, hand sleeve, wrist sleeve and combinations thereof; wherein said sleeve is a partially closed region in the form of a loop secured at both ends thereof with at least two openings for insertion of said appendage including a thumb, finger, palm, hand and wrist; and wherein said sleeve is attached to the inside or interior region of said front or rear section; wherein said first or second section having at least one of said pockets or said sleeves may be used separately as a mitten by means of a user's hand or an appendage thereof being inserted into at least one of said pockets or sleeves; wherein said joinder means is selected from a hook and loop closure, slider closure, mechanical snap, button, magnetic closure, magnetic snap, zipper, and combinations thereof; wherein said first and second section may either be joined to form an integrated unit in the form of glove; or may be separated to use as one or two individual mittens or trivets; wherein said first and second section are constructed of a thermal panel of an insulative material.

11. The integrated tool system of claim 10 wherein said joinder means is a zipper; wherein said zipper is located on said bias portion at a location having a displacement from said periphery of said front and rear sections equal to at least a distance selected from (a) the height of said zipper; (b) the height of the slider mechanism of said zipper; or (c) the height of said zipper combined with the height of said slider mechanism of the zipper.

12. The integrated tool system of claim 10 wherein said front and rear sections comprise thermal panels of an insulative material; wherein said thermal panels are selected from a single layer, double layer or triple layer of said insulative material; and wherein said layer of insulative material has an R value of between 1.0 to 20 when combined into three or more layers; or alternatively between 1.0 to 10 when combined into two or more layers; or alternatively between 1.0 to 5 when using a single layer thereof.

13. The integrated tool system of claim 12 wherein said thermal panels of insulative material are quilted across their cross-sections to form a quilted surface pattern on at least one exterior side of at least one of said front or rear sections; and wherein said quilted surface pattern provides at least one of either an improved gripping ability and increased insulative value of the exterior side of said thermal panels.

14. The integrated tool system of claim 10 wherein at least one exterior side of at least one thermal panel has been modified to exhibit an additional beneficially property; wherein said modification is performed on at least one layer of said panel by a treatment mean applied either to said panel or to at least one surface of said panel; wherein said treatment means provides at least one beneficial property selected from anti-static, easier-cleaning, grip or friction enhancement, flame resistant, water-repellency, oil-repellency, soil resistance, stain resistance, antimicrobial resistance, germicidal activity, odor control, antistatic properties, and combinations thereof; wherein said treatment means comprises use of a treatment agent applied to at least one layer of at least one said panel by means of dipping, soaking, spraying, rolling, pressing or bonding, or a combination thereof; and wherein said treatment agent is selected from a bonded abrasive, friction coating, polymer, copolymer, silicone resin, fluoropolymer, perfluorinated copolymer, mineral, polysiloxane, quaternary biocide, silver biocide, silver nanoparticles, resin, wax, and combinations thereof.

15. The integrated tool system of claim 14 wherein said treatment means is applied to at least one exterior surface of at least one said thermal panel; wherein said treatment means is applied in a non-continuous manner in the form of a pattern of dots, lines, squares, squiggles, and other similar geometric patterns; wherein said treatment means is present as a discreet coating disposed on the surface of said thermal panel; and wherein said treatment means provides improved grip and friction enhancement to said surface of said panel compared to an untreated surface.

* * * * *